US009440825B2

(12) United States Patent
Xydias

(10) Patent No.: US 9,440,825 B2
(45) Date of Patent: Sep. 13, 2016

(54) LEVEL WIND ASSEMBLY FOR A WINCH DRUM INCLUDING A TENSIONING ARM

(76) Inventor: Harry Xydias, Plympton (AU)

( * ) Notice: Subject to any disclaimer, the term of this patent is extended or adjusted under 35 U.S.C. 154(b) by 201 days.

(21) Appl. No.: 13/876,588

(22) PCT Filed: Sep. 29, 2011

(86) PCT No.: PCT/AU2011/001242

§ 371 (c)(1),
(2), (4) Date: Mar. 28, 2013

(87) PCT Pub. No.: WO2012/040777

PCT Pub. Date: Apr. 5, 2012

(65) Prior Publication Data

US 2013/0187105 A1 Jul. 25, 2013

(30) Foreign Application Priority Data

Sep. 29, 2010 (AU) ..... 2010224459

(51) Int. Cl.

| | |
|---|---|
| ***B66D 1/36*** | (2006.01) |
| ***B66D 1/30*** | (2006.01) |
| ***B66D 1/38*** | (2006.01) |
| ***B66D 1/72*** | (2006.01) |
| ***B66D 1/50*** | (2006.01) |

(52) U.S. Cl.

CPC . *B66D 1/36* (2013.01); *B66D 1/30* (2013.01); *B66D 1/38* (2013.01); *B66D 1/50* (2013.01); *B66D 1/72* (2013.01)

(58) Field of Classification Search

USPC ..... 254/334–336, 383, 385

See application file for complete search history.

(56) References Cited

U.S. PATENT DOCUMENTS

| | | | | |
|---|---|---|---|---|
| 4,588,142 | A * | 5/1986 | Malzacher | 242/390.5 |
| 5,002,238 | A * | 3/1991 | Inhofer et al. | 242/157.1 |
| 2005/0087644 | A1* | 4/2005 | Kim | 242/390.8 |

FOREIGN PATENT DOCUMENTS

| | | | |
|---|---|---|---|
| GB | 526862 | A | 9/1940 |
| GB | 1379386 | A | 1/1975 |
| JP | 5471165 | U | 8/1972 |
| JP | S471165 | U | 8/1972 |
| JP | 55353765 | U | 5/1978 |
| JP | 57141990 | U | 9/1982 |
| JP | 558106392 | U | 7/1983 |

* cited by examiner

*Primary Examiner* — Emmanuel M Marcelo
*Assistant Examiner* — Angela K Caligiuri
(74) *Attorney, Agent, or Firm* — Bio Intellectual Property Services LLC (Bio IPS); O. (Sam) Zaghmout

(57) ABSTRACT

The present invention relates to an improved level wind arm for a winch drum assembly, and a winch drum assembly incorporating such a level wind arm. The level wind arm includes a cross member adapted to bias against an outwardly extending portion of rope, the cross member being concave so that more force is required for the rope spindle associated with the cross member to "climb" the slope of the cross member, causing a momentary pause in motion of the spindle after it reaches the end of wind stroke. This momentary pause allows for rope being wound onto the drum to rise up the end wall of the drum to create a new layer which is aligned and consistent with the layer below, without causing gaps in the rope or other circumstances which could lead to the rope accumulating at any one point, or becoming tangled. The present invention also includes means of ensuring that tension is maintained in the rope, and that the rope does not jump off the reel and, for example, into the clutch mechanism.

15 Claims, 3 Drawing Sheets

LEVEL WIND ASSEMBLY FOR A WINCH DRUM INCLUDING A TENSIONING ARM

The present invention relates to a level wind assembly for a winch drum, in particular, to an assembly including a level wind arm biased against a rope (or chain, cable or the like) extending outwards from the winch drum, ensuring level winding of the rope, and a tensioning arm associated with the level wind arm for maintaining tension in the rope at all times. The invention also relates to a winch assembly incorporating the level wind assembly.

BACKGROUND OF THE INVENTION

It is to be understood that reference to a winch reel herein is the typically cylindrical portion of the winch drum assembly about which rope or other similar rope-like material is wound. Further, although the present invention relates generally to boat winches, it should not be limited to this application. For example, the winch assembly could equally well be used in other similar applications which require the level winding of a rope. It is to be still further understood that any use of the word "rope" herein may incorporate within its meaning, chains, wire, cord, cables and any other rope-like material that could be wound around the reel.

Winches are well known devices used on boats for raising and descending anchors. The anchor is connected to a rope or chain which is wound around a reel portion of a winch drum typically powered by a motor for raising and/or descending the anchor. The winch drum is usually positioned a short distance rearward from the front of the boat and the rope is guided by rollers typically positioned on the front deck.

A problem with some boat winches was that during raising of the anchor, the rope does not level wind, that is, it tends to accumulate at the centre of the winch drum or climb up the opposed side walls of the drum. Accumulation of the rope may result in jerky movement during descent of the anchor, damage to the rope, and in some instances may even prevent the anchor from descending due to excessive tangling. In assemblies where the winch drum rotates through the reduction gearing of the motor, such jerky movements during descent may result in damage to the motor and other parts of the assembly.

In addition, there may be circumstances, particularly in winch drums which have the capacity to free fall, in which proper contact between the rope and drum reel is not achieved, presenting a further situation for damage to the rope and snarling or tangling of the same.

The present inventor is the owner of Australian Letters Patent No. 2007202072 relating to a level wind arm associated with a winch drum assembly which overcomes at least some of the abovementioned problems. The inventor is also the owner of a co-pending Australian patent application no. 2009904669 relating to an improvement on the level wind arm in the form of a concave biased cross member. The contents of both of these patents are incorporated by reference herein.

The reader will appreciate when reading these prior patents that a rope spindle associated with the cross member is rotatable to accommodate forward and backward motion of the rope, and also slideable along the cross member to allow for movement of the rope as it is wound or unwound from the drum. The cross member is biased and thereby exerts a pressure on the rope a short distance from the drum to ensure that rope is wound or unwound about the drum in a level and controlled manner.

Whilst these winches have proven to be effective, a problem has been identified by the present inventor during occasions when the rope becomes de-tensioned. This may occur, for example, when an inexperienced boat driver is trying to manoeuvre the boat when anchoring. When the rope becomes de-tensioned, the effectiveness of the level wind arm is adversely affected in that it can result in the rope not being wound in the manner intended. There is a need for ensuring that tension in the rope is maintained at all times notwithstanding factors which may result in de-tensioning of the rope.

It is therefore an object of the present invention to overcome at least some of the aforementioned problems or to provide the public with a useful alternative.

SUMMARY OF THE INVENTION

Therefore in one form of the invention there is proposed a tensioning arm for use in a winch drum assembly having a tether means such as a rope extending out of the winch drum reel, said tensioning arm including a contact portion which extends across said winch drum reel in a direction substantially parallel with an axis of rotation of said reel, said contact portion being rotatably biased against said reel to thereby maintain tension in said tether means.

Preferably said winch drum reel is in the form of a rotatable cylinder extending between two outer side walls, said tensioning arm contact portion adapted to span across said cylinder and between the outer side walls and substantially parallel with the axis of rotation.

In preference said contact portion is downwardly biased against said reel.

Preferably said contact portion is in the form of a roller rotatable so as to allow for movement of said tether means to and from said winch drum reel.

In preference said tensioning arm is adapted for use in association with a level wind arm assembly used to ensure level winding of said tether means about said reel.

Preferably said level wind arm assembly is rotatable with respect to the reel and said tensioning arm is adapted to move together with the level wind arm assembly.

In a further form of the invention there is proposed a tensioning arm for use in a winch drum assembly having at least one cross member adapted to apply a biased force on rope extending out from the winch drum a spaced apart distance from the winch drum reel to facilitate level winding and unwinding of rope, said tensioning arm including:

a body including a first end associated with said at least one cross member such that said tensioning arm first end is moveable with said cross member, and a free end extending towards the winch drum reel and biased thereagainst such that said free end applies a force on said winch drum to ensure tension is maintained in said rope.

Preferably said body is of a rigid construction and is pivotably associated with said at least one cross member such that said free end is rotatably biased against the drum reel.

In preference said tensioning arm free end includes a roller adapted to contact said rope, said roller being rotatable about an axis extending substantially parallel to the axis of rotation of said reel so as to not substantially obstruct movement of said rope during winding and unwinding.

Preferably said tensioning arm body includes a first portion fixed to said cross member and a second portion hingedly connected to said first portion, whereby said free end forms part of said second portion.

In a still further form of the invention there is proposed a level wind assembly for a winch drum including a winch drum reel, said level wind assembly including:

a level wind arm including a cross member configured to provide a rotatably biased force on rope extending out of said winch drum reel a spaced apart distance from said reel for ensuring level winding and unwinding of said rope; and a tensioning arm associated with said level wind arm cross member, said tensioning arm adapted to provide a rotatably biased force on said winch drum reel for maintaining tension in said rope.

Preferably said level wind arm is rotatable about the same axis of rotation as said winch drum reel.

In preference said level wind arm extends in a forwards direction with respect to the winch drum reel and is biased in an upwards direction.

Preferably said tensioning arm extends in a rearwards direction from the cross member and is biased in a downwards direction on said winch drum reel.

Preferably said level wind arm and said tensioning arm are biased using a spring biasing means.

In a yet further form of the invention there is proposed a level wind assembly for a winch drum including a winch drum reel, said level wind assembly including:

a level wind arm extending forwardly from said winch drum reel and including at least one cross member and a spindle rotatably associated with said at least one cross member and slideable therealong, said spindle including receiving means which rotatably contacts a tether extending outwardly from said winch assembly, said cross member adapted to bias against said tether to facilitate level winding of said tether about said winch drum reel; and a tensioning arm associated with the at least one cross member and extending rearwardly therefrom, said tensioning arm including a first end pivotably connected to said cross member and moveable therewith, and a biased free end adapted to apply a substantially downward force on rope wound about said reel to thereby maintain rope tension.

Preferably said tensioning arm biased free end includes a roller adapted to contact said rope, said roller being rotatable to as to not substantially obstruct movement of said rope during winding and unwinding.

In preference said at least one cross member includes a first cross member along which said spindle is slideable including a vertical component causing said spindle to pause momentarily at the end of each stroke, thereby facilitating the consistent formation of layers about the winch drum.

Preferably said level wind arm includes a second cross member disposed above said first cross member.

In preference said spindle is slideable along the first cross member, said spindle being housed inside a bracket which slideably engages and said first cross member and which further includes a means of being guided along the second cross member disposed there above.

In a still further form of the invention there is proposed a winch drum including a level wind assembly as characterised above.

BRIEF DESCRIPTION OF THE DRAWINGS

The accompanying drawings, which are incorporated in and constitute a part of this specification, illustrate an implementation of the invention and, together with the description, serve to explain the advantages and principles of the invention. In the drawings.

DESCRIPTION OF INTEGERS

Figure 1:
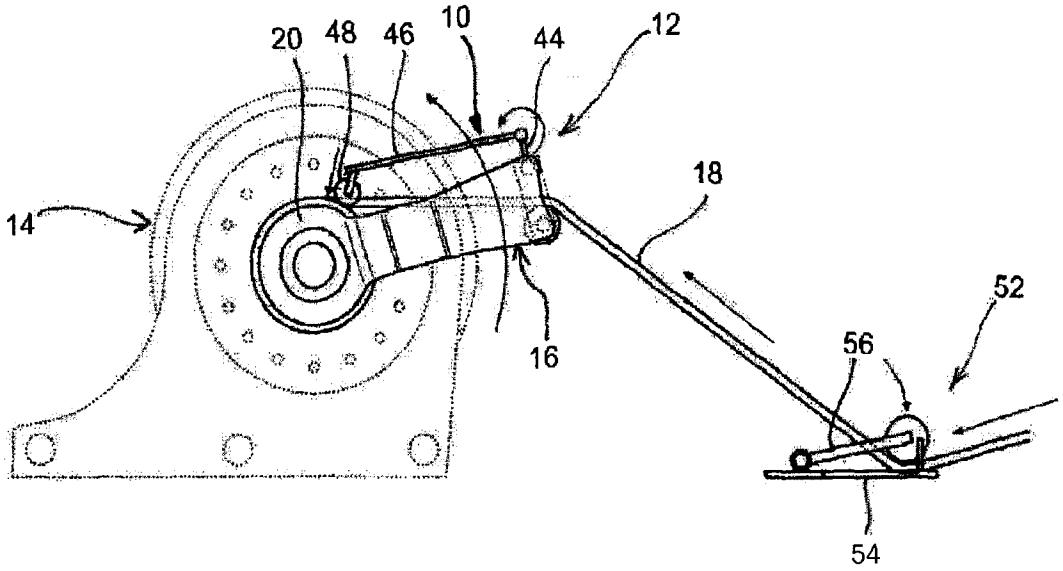
FIG. 1 illustrates a side view of a level wind assembly when an associated anchor is being raised, the assembly being shown according to a first and preferred embodiment of the present invention with rope being wound such that it extends out from the top of the reel.

10 Tensioning arm
12 Level wind assembly
14 Winch drum assembly
16 Level wind arm
18 Rope
20 Winch drum
22 Mounting plate
24&26 Side plates
28 Motor
32&34 Level wind arms
36 Cross member
38 Second cross member
40 Cross member bracket
42 Spindle
44 Tensioning arm first portion
46 Tensioning arm second portion
48 Roller
50 Bracket slit
52 Tensioning assembly
54 Base
56 Roller

DESCRIPTION OF THE PREFERRED EMBODIMENTS

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

The present invention relates to a tensioning arm 10 and, in particular, a level wind assembly 12 incorporating a tensioning arm 10 for use with a boat winch drum 14 (although the invention is not intended to be limited to boat winches). The tensioning arm 10 is operable in association with a level wind arm 16 also forming part of the assembly 12. The tensioning arm 10 ensures that tension is always maintained in rope 18 extending out from the winch drum reel 20, and results in flawless winding and unwinding about the drum, every time, even in circumstances where a boat driver may be inexperienced and rope extending out from the drum becomes de-tensioned.

Figure 3:
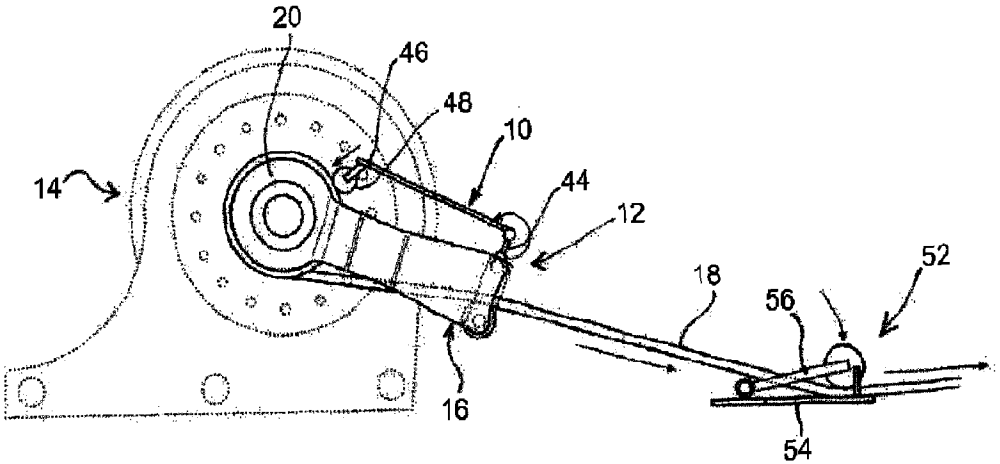
FIG. 3 illustrates a side view of the level wind assembly of FIG. 2 when the anchor is descending in a free fall state.
Figure 2:
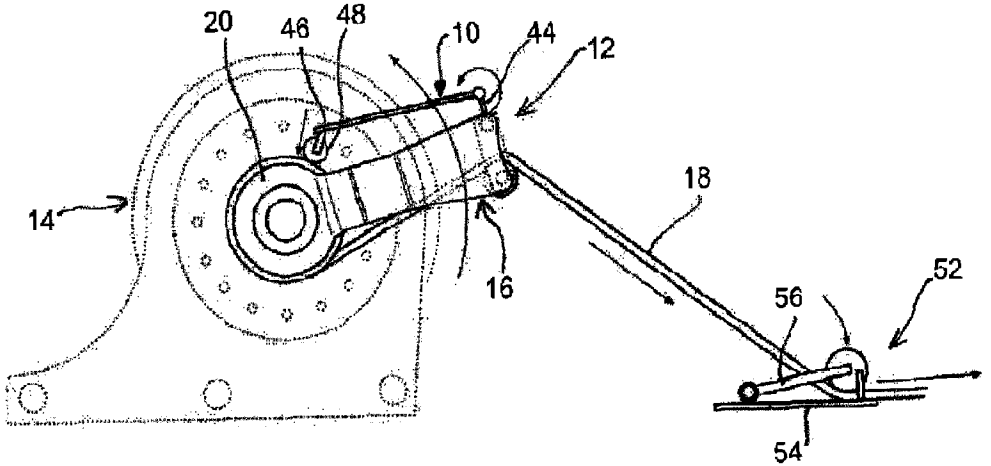
FIG. 2 illustrates a side view of a level wind assembly when an associated anchor has commenced decent, the assembly being shown according to a second embodiment of the invention with rope being unwound such it extends out from the bottom of the reel.
Figure 4:
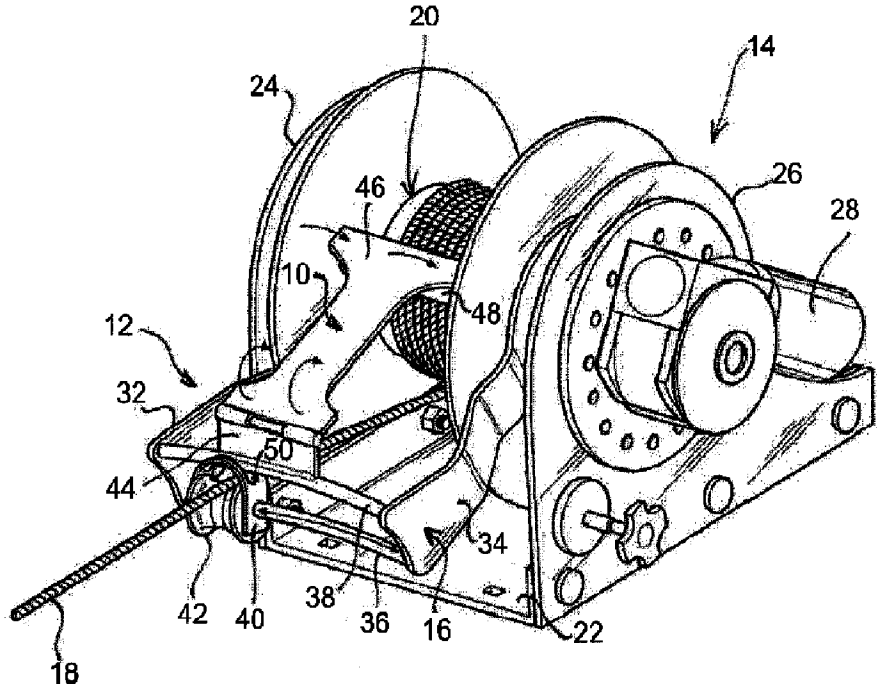
FIG. 4 illustrates a perspective view of the level wind assembly in the state shown in FIG. 3.

The invention may be applied to a winch drum 14 when rope extends out from above the drum reel 20 (as shown in the configuration of FIG. 1) or from below the drum reel 20 (as shown in the configuration of FIGS. 2-4). The preferred and most effective use of the invention is in the configuration shown in FIG. 1, that is, when the rope extends out from the top of the drum. It may well be that the rope is of a length that the drum continues to rotate in the same direction when fully unwound and so the configuration will flip between these two configurations. Whatever the configuration, the level wind assembly 12 and in particular the tensioning arm 10 of the present invention will ensure level winding and unwinding, regardless of whether tension in the rope is lost.

The winch 14 and level wind assembly 12 will now be described in more detail. The prior art components are only described briefly, but the reader is directed to the patents mentioned in the preamble of the invention for a more detailed description of those components.

The winch drum reel 20 is supported horizontally above a mounting plate 22 which has two side walls 24 and 26 extending upwardly on opposed sides of the winch drum reel 20. A motor 28, typically a DC motor, is mounted to one of the side walls. As mentioned, the level wind assembly 12 of the present invention includes a level wind arm 16 which is biased and adapted to ensure level winding of rope 18 around the reel 20. The rope is wound about the winch drum reel, and an anchor (not shown) is attached at a free end thereof. Guide rollers (not shown) may be used to guide rope 18 extending between the winch drum 14 and the anchor. The biased arm 16 is used to exert a force on the rope extending out of the winch drum 14 and thereby ensure level winding of the rope about the winch drum reel 20 during lowering and raising of the anchor.

The level wind arm 16 includes two arms 32 and 34 which extend outwardly from the winch drum 14 and which are preferably pivotable about the same axis as the axis extending through the winch drum reel 20 (not shown). The arms 32 and 34 are connected at their free ends by a cross member 36 which includes a concave curve along its length. In a preferred embodiment, there is also a second cross member 38 positioned a short distance above cross member 36, the cross members 36 and 38 being substantially identical. A bracket 40 extends between the cross members 36 and 38, and is adapted to slideably engage the lower cross member 36 whilst housing a rotatable spindle 42 which is also slideable along the lower cross member 36. The bracket 40 does not engage the upper cross member 38 in the same manner but is rather guided along it for reasons that will be described in more detail below.

The skilled addressee would realise that when the spindle 42 is made to move along the cross member 36 by force of the rope, the bracket 40 will move with it. The purpose of the bracket 40 is to ensure that the rope 18 will remain inside the bracket 40 and prevent it from jumping out of the drum. The present invention is not intended to be limited to any one type of bracket configuration.

The level wind arm 16 could be biased either upwardly or downwardly, but in a preferred embodiment and in the embodiment shown it is biased upwardly. Regardless of whether the rope extends from out the bottom of the reel 20 or the top, the upward bias of the arm 16 causes a force on rope 18 extending over the spindle 42. This is achieved using a spring mechanism (not shown), but any other biasing means could be used. The concave shape of the cross members 36 and 38 provides benefits over say a horizontal cross member design, such benefits being described in the Applicant's co-pending patent application.

The configuration and purpose of tensioning arm 10 forming part of the assembly 12 will now be described. The tensioning arm 10 includes a first portion 44 mounted directly to the upper concave cross member 38 such that it extends substantially upwardly therefrom, and a second portion 46 hingedly connected to the first portion 44. The configuration of the hinged connection between the first and second portions is such that the second portion 46 biases down against the winch drum reel 20 and, in particular, against rope wound about the reel 20. Located at the free end of the second portion 46 is a roller 48 which substantially spans the width of the reel 20 between its side walls and is the portion of the tensioning arm 10 that contacts the rope 18. The roller 48 is rotatable so as to not obstruct rotation of the reel 20 during winding or unwinding of the rope. The purpose of the roller 48 is to ensure that tension is never lost in rope extending about the reel.

The skilled addressee would realise that in being mounted to the level wind arm 16 like so, no matter where the level wind arm 16 is located, i.e. whether it be at a lower position shown in the anchor free fall position of FIG. 3, or the higher position shown in the anchor decent position of FIG. 2, the tensioning arm 10 will always bias against the winch drum reel 20 and thereby ensure tension is maintained on rope extending about the reel 20 at all times. Those skilled in the art will further appreciate that regardless of whether the rope extends from above the reel as shown in FIG. 1, or from below the reel as shown in FIGS. 2-4, the roller 48 of the tensioning arm 10 will always be biased against a portion of the reel 20 and thereby provide a final means of ensuring tension and hence satisfactory operation of the associated level winding arm. Without the tensioning arm 10 of the present invention, tension in the rope and hence effective operation of the level winding arm is not always guaranteed.

It is to be understood that this is but one example of how the tensioning arm 10 could be configured. For example, the arm 10 need not necessarily comprise two portions. The arm could comprise a single member hingedly connected directly to the upper cross member 38 and bearing down on the reel via a roller. Furthermore, whilst the tensioning arm is constructed of metal in a preferred embodiment, this need not necessarily be the case. An important aspect of the arm is that it is in some way associated with the biased level wind arm because that arm can move quite considerably during raising and lowering of an anchor, and so it is preferred that tensioning arm 10 provide a force at an appropriate location on the reel 20 relative to the position of the arm 16.

Figure 5:
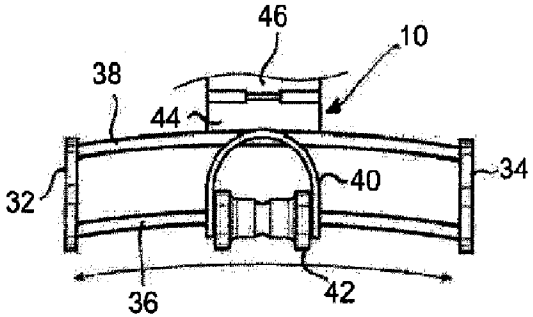
FIG. 5 illustrates an enlarged front view of part of the level wind assembly including the level wind arm and the tensioning arm.

Turning to the bracket 40 again, it can be seen in the drawings and in particular FIGS. 4-5 that it is of an inverted U-shape and includes a slit 50 extending along its top surface which is shaped to accommodate therein the upper concave cross member 38 which thus acts as a guide for the bracket 40. This bracket configuration is useful because the slit 50 allows for the first portion 44 of the tensioning arm 10 to be fixed to the upper cross member as shown without interfering with movement of the bracket 40 back and forth along the cross member. However, as mentioned earlier, other configurations are also possible.

Some situations may also require the use of a tensioning assembly 52 spaced in front of the winch above the boat deck. This assembly is described in the Applicant's co-pending patent application and so is only described here in minor detail. It includes a base 54 for mounting above the deck, and a spring biased roller 56, the rope 18 being adapted to extend between the roller 56 and the base 54. The tensioning assembly is configured such that it will not significantly affect release of the rope from the winch drum reel, but will prevent the rope from travelling in the opposite direction when tension in the rope between the assembly and the anchor is lost for any reason.

The advantages of the present invention should now be apparent. In associating a tensioning arm 10 in the configuration shown and described with the level wind arm 16, the winch 14 is provided with a full proof system of ensuring level winding and unwinding of rope about the winch drum reel regardless of tension being lost in the rope for any reason.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. A level wind assembly for a winch drum including a winch drum reel having an axis of rotation, said level wind assembly including:

a level wind arm having a proximal end and a distal end, said proximal end aligned with said axis of rotation of the winch drum reel, said distal end of said level wind arm extending outwardly from said winch drum reel and including a cross member at or adjacent thereto and providing a rotatably biased force on a tether means extending directly out of said winch drum reel a spaced apart distance from said reel for facilitating level winding of said tether means about said winch drum reel; and a tensioning arm extending from or adjacent said distal end of the level wind arm such that the tensioning arm forms an extension of the level wind arm, said tensioning arm configured such that it extends in an opposite direction back towards and over the winch drum reel and is rotatably biased with respect to the level wind arm to cause a contact portion at or adjacent a distal end of the tensioning arm to provide a rotatably biased force on the tether means wound about said winch drum reel.

2. The level wind assembly of claim 1 wherein said winch drum reel is in the form of a rotatable cylinder extending between two outer side walls.

3. The level wind assembly of claim 2 wherein said contact portion spans across said reel and between the outer side walls, and extends substantially parallel with the axis of rotation of said reel.

4. The level wind assembly of claim 3 wherein said contact portion is in the form of a roller which is rotatable about an axis extending substantially parallel to the axis of rotation of the winch drum reel to allow for the tether means to be wound and unwound about said reel, notwithstanding the rotatably biased force of the roller on the tether means wound about said reel.

5. The level wind assembly of claim 2 wherein said level wind arm includes two support arms disposed on outer sides of said outer side walls and said cross member extends between distal ends of each support arm, the support arms being rotatably biased by a spring operatively disposed between at least one support arm and a corresponding side wall.

6. The level wind assembly of claim 5 wherein the tensioning arm is rotatable about said cross member and biased relative thereto by the spring operatively disposed between the cross member and the tensioning arm.

7. The level wind assembly of claim 1 wherein said level wind arm is rotatable about an axis of rotation that extends through or parallel to the axis of rotation of said winch drum reel.

8. The level wind assembly of claim 1 wherein said level wind arm extends in a forwards direction with respect to the winch drum reel and is biased in an upwards direction.

9. The level wind assembly of claim 1 wherein said tensioning arm extends in a rearwards direction from the cross member and is biased in a downwards direction on said winch drum reel.

10. The level wind assembly of claim 1 wherein said level wind arm and said tensioning arm are each biased using a respective spring biasing means.

11. The level wind assembly of claim 1, wherein said cross member includes a spindle rotatably associated therewith and slideable therealong, said spindle including receiving means which rotatably contacts said tether means extending outwardly from said winch reel.

12. The level wind assembly of claim 11 wherein said cross member includes a vertical component in the form of a concave curve along its length, causing said spindle to pause at the end of each stroke as a result of being forced to climb up the concave curve, thereby facilitating stacking of the tether means when forming a new layer about the winch drum reel.

13. The level wind assembly of claim 1 wherein said cross member is a first cross member and said level wind arm includes a second cross member disposed above said first cross member, said second cross member including a bracket slideable along both first and second cross members and including flange portions between which said spindle is disposed, wherein movement of said spindle along said first cross member causes said bracket to move along said second cross member, said bracket defining a perimeter for said tether means and thereby preventing said tether means from jumping off said winch drum reel.

14. The level wind assembly of claim 1 wherein said reel is rotatable through operation of an electric motor.

15. The level wind assembly of claim 1 wherein said tether means is in the form of a rope, chain, or cable.

* * * * *